US005984131A

United States Patent [19]

Krueger et al.

[11] Patent Number: 5,984,131

[45] Date of Patent: Nov. 16, 1999

[54] LID PLATE

[75] Inventors: John A. Krueger, Brookfield; Ronald A. Perez, Saint Cloud, both of Wis.

[73] Assignee: Sparks International, Inc., Brookfield, Wis.

[21] Appl. No.: 09/064,622

[22] Filed: Apr. 23, 1998

[51] Int. Cl.[6] ..... B65D 73/00

[52] U.S. Cl. ..... 220/574; 220/23.83; 220/575

[58] Field of Search ..... 220/574, 23.83, 220/23.86; 206/575, 515

[56] References Cited

U.S. PATENT DOCUMENTS

| | | | |
|---|---|---|---|
| 4,732,274 | 3/1988 | Bouton | 206/561 |
| 4,877,151 | 10/1989 | Rush | 206/514 |
| 4,938,373 | 6/1990 | McKee | 220/23.86 |
| 5,058,737 | 10/1991 | Patterson | 206/217 |
| 5,060,820 | 10/1991 | Boerner | 220/574 |
| 5,176,283 | 1/1993 | Patterson | 220/574 |
| 5,207,743 | 5/1993 | Costarella et al. | 220/574 |
| 5,234,125 | 8/1993 | Roberts | 220/574 |
| 5,249,700 | 10/1993 | Dumke | 220/574 |
| 5,292,028 | 3/1994 | Patterson | 220/574 |
| 5,385,255 | 1/1995 | Varano | 220/306 |
| 5,441,164 | 8/1995 | Beck et al. | 220/574 X |
| 5,538,154 | 7/1996 | Von Holdt | 220/277 |

*Primary Examiner*—Steven Pollard
*Attorney, Agent, or Firm*—James A. Geppert

[57] ABSTRACT

The invention is generally directed to a plate-lid for serving selected food items which are to be used in connection with a beverage container. An inner circular ribbed region of the plate-lid snaps over the annular ridge or rim of the beverage container thereby forming a seal to prevent spillage of liquid from the beverage container. The ribbed region includes a plurality of inwardly directed lands with a plurality of flutes of varying circumferential lengths positioned between the lands in order to space the lands about the inner plate-lid. The outer area of the plate-lid provides sections or wells for the placement of food stuffs and/or condiments. This mating means serves to resist lateral movement between the beverage container and the food holding section or tray when they are joined together. The plate-lid also provides the option for a straw insertion in a location where the straw will not interfere with the food items or condiments being served on the plate-lid. The plate-lids are stackable without nesting. A plurality of lug members extend downwardly from a surface or plane of the plate-lid and are positioned at predetermined segments with reference to the center of the plate-lid. The lug members also extend downwardly a predesigned distance so as to position the surface or horizontal plane of a first plate-lid of a stack coplanar with the surface or plane portion of the plate-lid on which the first plate-lid rests.

22 Claims, 6 Drawing Sheets

LID PLATE

BACKGROUND OF THE INVENTION

The invention disclosed and claimed herein generally pertains to an improved food serving tray or plate which is intended for use with a separate container for a beverage or other edible food item. More particularly, the invention pertains to a serving tray of the above type wherein a user, by employing only a single hand, can firmly and conveniently support and carry both the tray and container.

There are numerous instances of food service wherein (1) one or more food items are served together with a beverage, and (2) it is convenient or essential for the recipient of the food items and beverage to be able to keep one of his or her hands free for some purpose. For example, it is a nearly universal practice, at many parties and other social functions, to serve food items on a plate, along with a beverage in a separate vessel or container. If a table or other horizontal supporting surface is not available, a recipient may try using the hand holding the beverage container to move food from the plate to his or her mouth. As an alternative practice, a recipient may attempt to balance the beverage container on the plate, in order to free his or her other hand for eating or other purpose, such as opening a door or shaking hands with another person. These practices tend to be very awkward, and frequently result in spillage and other undesirable consequences. Problems of the above type are also encountered at many sporting and other entertainment events where refreshments are served.

Fast food restaurants, particularly those having "drive-through" capability, provide a further example of food service having the dual characteristics set forth above. In such restaurants a motor vehicle is driven up to a window through which food is served. A typical order includes food items such as hamburgers, french fries, tacos, or the like, and a beverage such as a milk shake, carbonated beverage, or coffee. Frequently the vehicle driver, particularly if he or she is alone, will find it necessary to hold both the food and the beverage with one hand, while keeping the other hand free for further vehicle operation.

Prior art serving trays for supporting and carrying both food items and a separate beverage container or the lids for the beverage container are exemplified by patents such as U.S. Pat. No. 5,060,820 issued on Oct. 29, 1991 to Boerner; U.S. Pat. No. 4,938,373 issued on Jul. 3, 1990 to McKee; U.S. Pat. No. 4,732,274 issued on Mar. 22, 1988 to Bouton; U.S. Pat. Nos. 5,058,737 and 5,176,283 and 5,292,028, respectively issued on Oct. 22, 1991, Jan. 5, 1993 and Mar. 8, 1994 to Patterson; U.S. Pat. No. 4,877,151 issued on Oct. 31, 1989 to Rush; U.S. Pat. No. 5,385,255 issued on Jan. 31, 1995 to Varano; and U.S. Pat. No. 5,538,154 issued on Jul. 23, 1996 to Von Holdt.

There are many different inventions for a tray or beverage lid. The Bouton invention (U.S. Pat. No. 4,732,274) discloses a portable tray table with reference to arm support. The McKee invention (U.S. Pat. No. 4,938,373) describes a plate which interfaces with the beverage container utilizing a press fit V-type gripping relationship. The Boerner invention (U.S. Pat. No. 5,060,820) refers to a tray which interfaces with a beverage container via extendible arms for stabilizing the assembly. The Patterson inventions (U.S. Pat. Nos. 5,058,737, 5,176,283 and 5,292,028) disclose plates or trays that interface with beverage containers via clips or channels. Some of the previous inventions will be further delineated in the following text.

The McKee invention utilizes a beverage container with specific regard to the "top and bottom" portions from which to interface with the McKee invention. The invention describes a press fit gripping relationship between the plate and the beverage container. McKee further delineates the invention with reference to an inverted V-type interface between the plate and the cup. The McKee invention cites materials for use with specific regard to injection molding.

McKee's invention requires a press fit gripping relationship between the plate and the cup; therefore, there is a gripping force between the plate and the cup at a point around the top circumference of the beverage container. The interface between the McKee invention and the beverage container is by an inverted V-type press fit. The McKee invention is not a snap fit interface and therefore does not provide a positive lock of the plate onto the beverage container. A press fit provides a fit under conditions of an interference or force fit. This type of plate may stack however, it will easily nest making the removal of one plate from a stack of plates difficult.

The McKee invention does not describe a snap fit interface. When a lid is snapped over a beverage container, a seal is maintained. The dimensions of the lid do not interfere with the dimensions of the beverage container at the top or side of the beverage container lip but rather the lid is snapped over the rim of the beverage container. When snapping the lid onto the beverage container, the initial diameter of the skirt of the lid is smaller than the outer dimensions of the lip of the beverage container. As the lid is pushed over the lip of the beverage container, the skirt of the lid is flexed over the lip until it snaps over the lip or rim of the beverage container.

The Boerner invention provides an interface between the plate and the cup via extensions which are either permanent or foldable. The extensions are an integral part of the original plate or attached to the plate by several suggested methods. A person using the Boerner invention will grasp both the extension and the beverage container simultaneously. The extensions lie substantially horizontal or perpendicular to the plane of food when they interface with the beverage container. The Boerner invention will not provide a method to seal the contents of the beverage container while the plate or tray is utilized with the beverage container.

All three of the Patterson inventions describe a plate and glass assembly which allows one to carry a plate and drinking glass in one hand. The assembly comprises a plate and a glass with a mechanism to interface between them such as a lip, U-channel, slot, tongue-and-groove, or the like to couple the plate to the cup. An optional drinking straw port is provided for some versions of the Patterson invention when it is not desirable to remove the plate. Patterson's invention also includes separate caps or clips for adapting any number of beverage container styles to fit a generic glass holder. There is no compliance or flexibility associated with Patterson's invention such as would be required for a snap fit type plate to beverage container interface. The plate geometry is disclosed as a horizontal or flat plate with no delineation as to food stuffs compartments. The preferred embodiment of the Patterson invention interfaces the plate with a lip or ridge on a partial edge of the beverage container.

The prior art associated with the Rush, Varano and Von Holdt patents refers to beverage container lids. This prior art represents lids with beaded rims for engaging the beverage container without reference to the duality of utilizing the lid for a plate or tray.

The invention disclosed within this submission refers to a mating relationship of a plate-lid to the beverage container which is distinctly different than any prior art. This invention refers to a snap fit relationship of the plate-lid to the beverage container. A seal is formed when the skirted area of the plate-lid engages around the lip or rim of the beverage container. This type of interface is described within the accompanying objects of invention and summary of invention. This type of mating interface improves the utility of the food serving tray or lid by providing a positive sealing mechanism of the plate-lid to beverage container over prior art.

SUMMARY OF THE INVENTION

The invention is generally directed to a plate-lid or tray for serving selected food items which is to be used in connection with an elongated container of a type used to retain a beverage. The plate-lid or tray generally comprises a food holding section disposed to carry the food items and a mating means for joining the food holding section upon the beverage container. The circular ribbed region of the plate-lid interfaces with the annular ridge or rim of the beverage container thereby forming a seal to prevent spillage of liquid from within the beverage container. The ribbed region includes a plurality of inwardly directed lands with a plurality of flutes of varying circumferential lengths positioned between the lands in order to space the lands about the inner plate-lid.

In the preferred embodiment, the plate-lid provides an interface for a straw insertion through the plate-lid into the beverage container. The straw junction is positioned or elevated so that the straw insertion location will not interfere with the food items or condiments being served on the plate-lid or tray. The preferred embodiment also provides for the ability to stack the plate lids on top of each other without nesting. This is accomplished through a plurality of lug members which extend downwardly from a surface or horizontal plane on one plate-lid and are positioned at predetermined segments along the surface or horizontal plane. The lug members also extend downwardly a predesigned distance so as to position a bottom surface of a recess of a first plate-lid of a stack coplanar with a portion of the plate-lid on which the first lid rests.

Variations in the wells or compartments of the outer circumferential food carrying sections of the plate-lid allow for differentiation of food stuffs and/or condiments to be placed within the plate-lid. These variations also provide for various portions or sizes to be utilized by altering the depth of the wells or compartments of the plate-lid.

The outer food holding sections provide for variability between complete wells to be circumferential around the entire inner plate-lid as snapped over the beverage container rim or partial wells along only a predetermined semi-circular region of the inner plate-lid circumference. Partial outer wells provide flexibility in placing the assemblies in cup holders typically utilized in automobiles.

OBJECTS OF THE INVENTION

An object of the invention is to provide an improved arrangement for serving one or more food items along in a plate-lid or tray which mates with a beverage container.

Another object is to provide an arrangement of the above type with a ribbed region which includes a plurality of inwardly directed lands with a plurality of flutes of varying circumferential lengths positioned between the lands in order to space the lands about the inner plate-lid. This arrangement allows for a snap type interface of the plate-lid or tray with an annular ridge or rim located around the beverage container thereby creating a seal.

Another object is to provide an arrangement of the above type wherein a number of the plate-lids or trays may be stacked together in a compact relationship without nesting. This is accomplished through a plurality of lug members extending downwardly from a surface or horizontal plane on one plate-lid and are positioned at predetermined segments along a surface or horizontal plane. The lug members also extend downwardly a predesigned distance so as to position a bottom surface of a recess of a first plate-lid of a stack coplanar with a portion of the plate-lid on which the first lid rests.

Another object is to provide variations of the plate-lid or tray design supporting both outer food holding regions which are either completely circumferential or partially circumferential with respect to the inner rim which interfaces around the entire rim or ridge portion of the beverage container.

Another object is to provide variations in the depth of the outer plate-lid food holding wells so that various portions of food items can readily be placed within the plate-lid or tray.

Another object is to provide a region for the insertion of a straw through the plate-lid or tray thereby accessing the liquid within the beverage container in such a manner that the insertion of the straw does not interfere with the food items or condiments located on the lid-plate or tray.

These and other objects of the invention will become more readily apparent from the ensuing specification, taken together with the accompanying drawings.

BRIEF DESCRIPTION OF THE DRAWINGS

The invention will be better understood and objects other than those set forth above will become more apparent when consideration is given to the following detailed description thereof. Such description makes reference to the annexed drawings wherein.

DETAILED DESCRIPTION OF A PREFERRED EMBODIMENT

Figure 2:
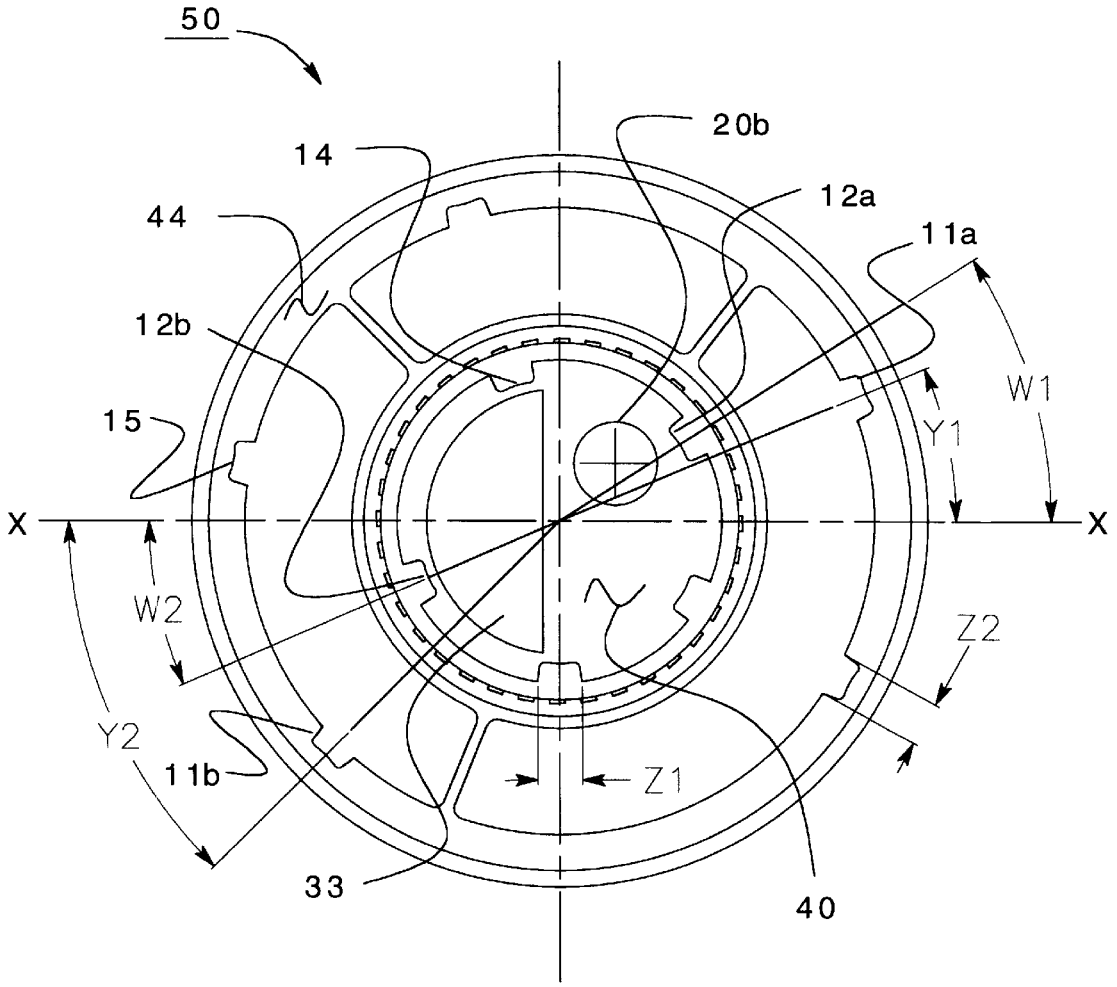
FIG. 2 is an overhead view showing an embodiment of the invention with reference to non-nesting mechanisms.
Figure 3:
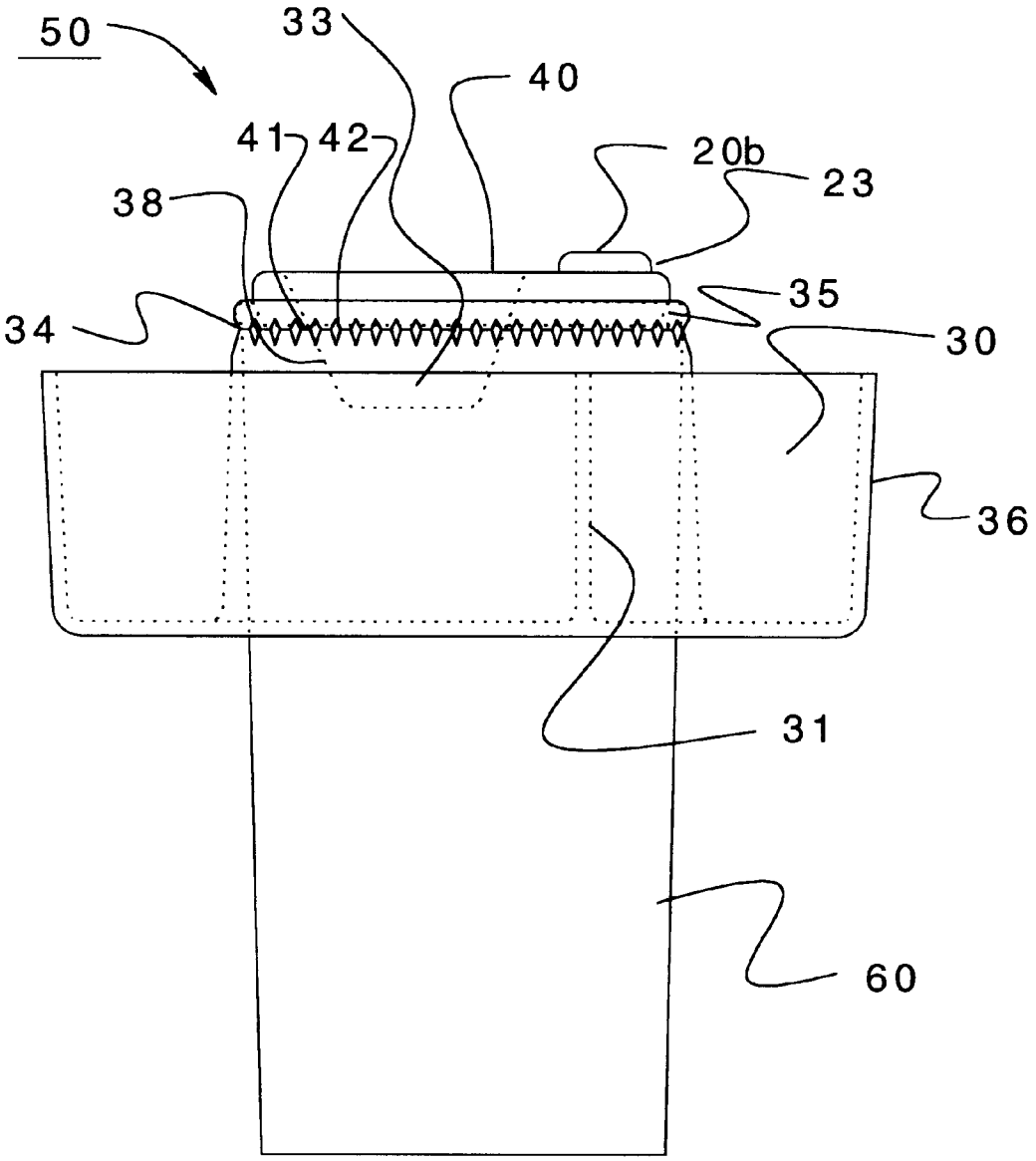
FIG. 3 is a side view of an embodiment of the invention attached to a beverage container.
Figure 4:
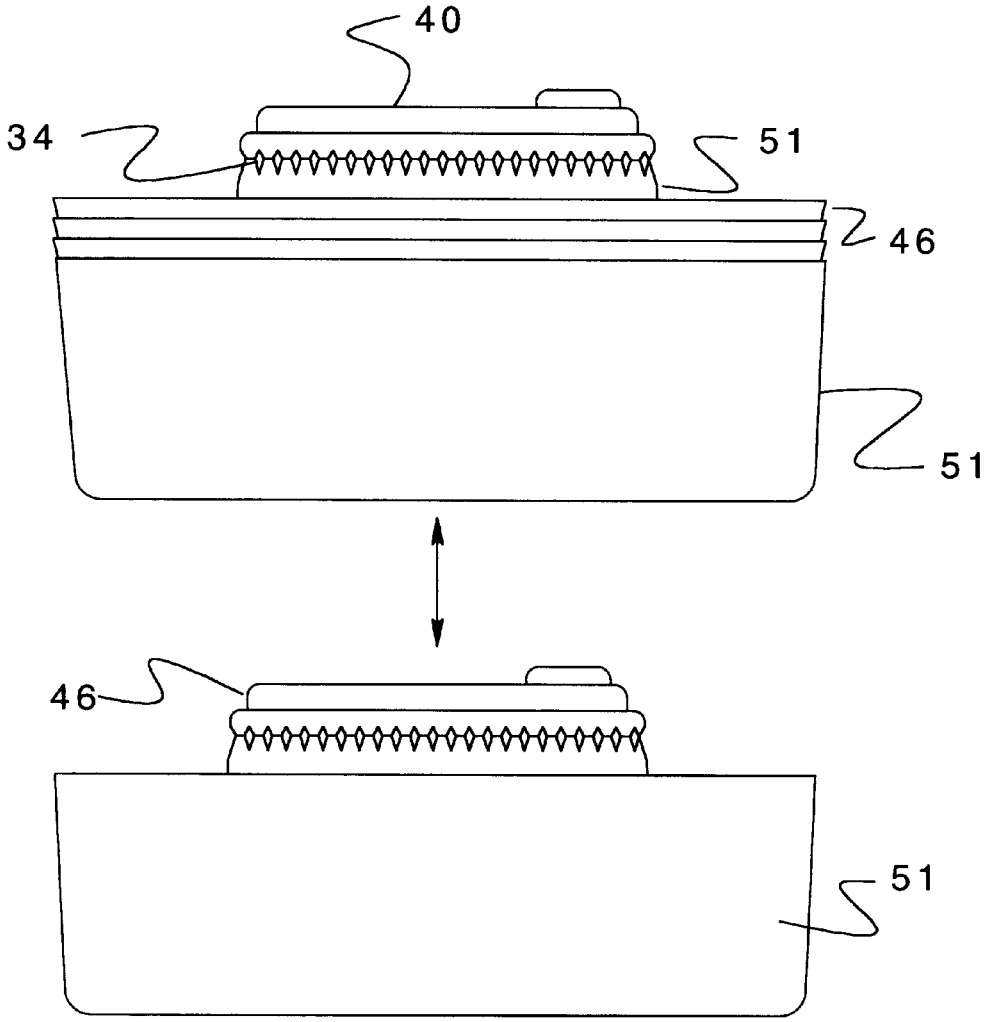
FIG. 4 is a sectional view illustrating the stackability of a plurality of the embodiments shown in FIG. 1.

FIGS. 1 through 4 show a disposable plastic thin walled plate-lid, which is designed for a single time use and could be used in fast food establishments, sporting events, entertainment functions and the like where it would be advantageous to combine both a plate or tray with a beverage container. As is seen in FIG. 4, these plate-lids are designed to be stacked with other plate-lids of essentially identical structure. When they are placed on a horizontal surface, no special lateral support is required such that the top lid may be readily removed from the stack as required.

Figure 1:
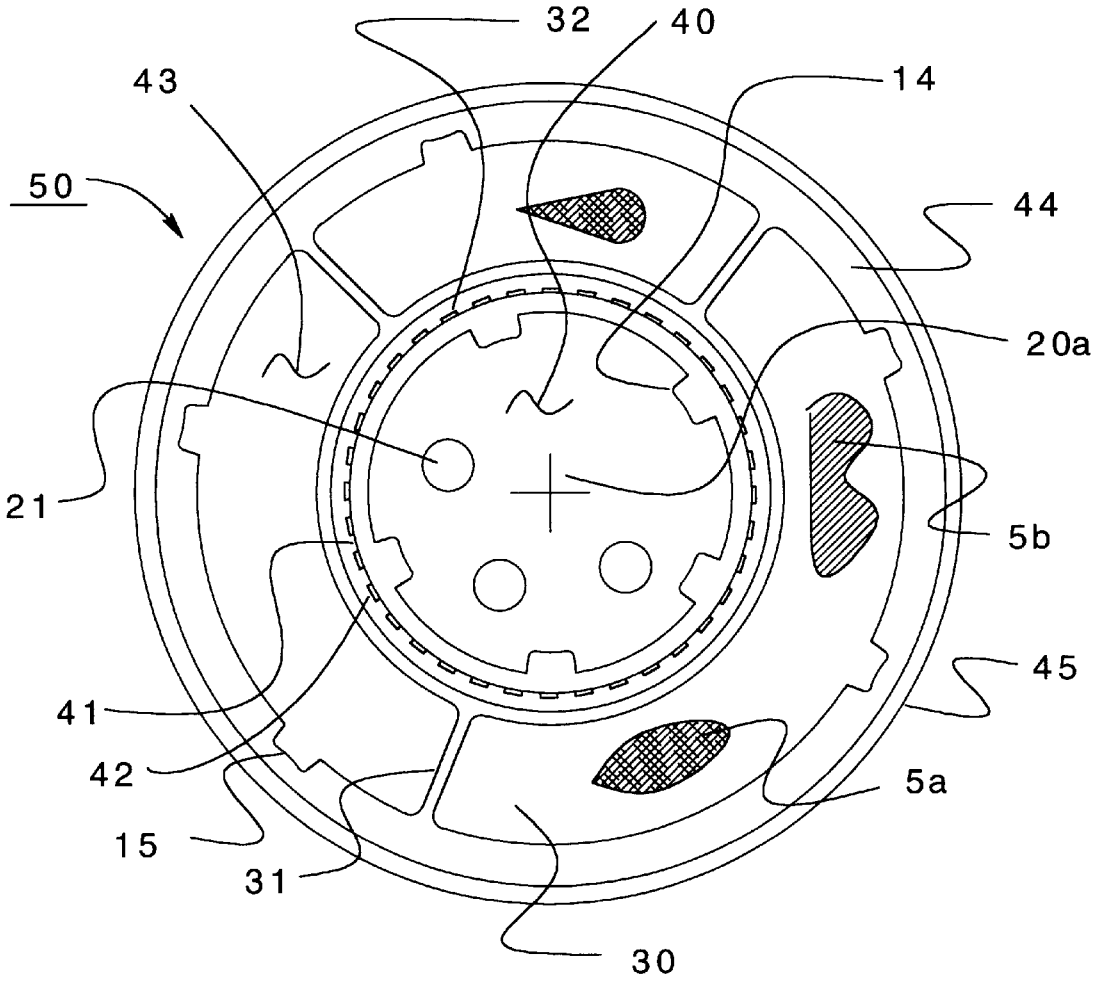
FIG. 1 is an overhead view showing an embodiment of the invention.

Referring to FIG. 1, plate-lid 50 shows an inner region 40 defined within the beaded skirt 32. The beaded skirt 32 provides lateral stability within a stack of plate-lids 50 as will be seen in accompanying figures by preventing adjacent plate-lids from telescoping out from the stack. The beaded skirt 32 is defined by a series of lands 41 interspaced by flutes 42 for which to engage the rim of the beverage container. The flutes 42 add resilience to the beaded skirt 32 in the radial direction. That is, the flutes 42 allow the skirt 32 to expand in the radial direction over the rim of a container and snap back below the rim to form a sealed container. The inner region 40 is further defined with a straw knockout 20*a* flat with respect to region 40 and three beverage type indicator dots 21 for which to differentiate the beverage type contained within the beverage container. The straw knockout 20*a* and indicator dots 21 are typically found on lids for beverage containers found at fast food establishments. The inner region 40 is further defined by several lugs 14 protruding toward the inner region 40. The function of these lugs will be described in FIG. 2. Around the beaded skirt 32 is an outer region 43 which is defined by a series of wells or channels 30 in which food stuffs 5*a* and 5*b* can readily be placed. The wells or channels 30 are divided by partitions 31 interspaced around the outer region 43 for dividing food stuffs and condiments. An outer flange 44 is positioned circumferentially around the outer region 43 terminating at an outer ridge 45. Within the outer flange 44 are a series of gaps 15 which function with similar respect as lugs 14.

FIG. 2 references a plate-lid 50 which is similar to the plate-lid of FIG. 1 with the addition of an inner well or channel 33 within inner region 40. The straw knockout 20*b* is elevated to ensure that the food stuffs or condiments within well or channel 33 do not interfere with the function of a straw located within straw knockout 20*b*. In order to prevent adjacent plate-lids of a stack of plate-lids from telescoping into one another beyond the designed extent, the lugs 14 must remain out of phase with one another, i.e. lugs 14 of adjacent lids must never line up. To accomplish this, the lugs 14, of each adjacent plate-lid in a stack are spaced at a different circumferential distance W from a consistent diametrical X axis of each plate-lid. Additionally, the lugs 14 themselves, also extend over a varying circumferential distance from that of the adjacent lids. A particularly desirable arrangement involves three varying plate-lid configurations exists such that every third plate-lid in a stack would be identical and the lugs 14 of the adjacent lids would remain out of phase. It should be noted that for plate-lid 50 of FIG. 2, lug 12*a* is positioned at angle W1 which is different than angle W2 of lug 12*b*. This will ensure that the small included angle of this plate-lid will remain out of phase with the adjacent plate-lid at all times.

Still referring to FIG. 2, gaps 15 which extend into the outer flange 44 function similar to lugs 14. Gap 11*a* is positioned at Y1 which is different than gap 11*b* at Y2 with respect to the diametrical X axis. The gaps vary in circumferential length Z2 and position Y as previously described with the angle W and length Z1 for lugs 14.

FIG. 3 refers to plate-lid 50 as engaged onto beverage container 60. The beaded rim 34 of plate-lid 50 is sealed onto rim 35 of beverage container 60 by flutes 42 interspaced between lands 41. The inner region 40 shows inner well or channel 33 at a depth of 38. The knockout straw 20*b* is shown at a height 23 with respect to inner region 40. Still referring to FIG. 3, outer well or channel 30 is partitioned by segment 31 and illustrated at depth 36. The depth 36 may be predetermined for the portion of food stuffs which are to be located within the outer well or channel 30.

Referring to FIG. 4, a series of plate-lids 51 are shown in coplanar relationship. The height 46 between inner region 40 and beaded rim 34 illustrates to the spacing between plate-lids 51 in a coplanar stack arrangement.

Figure 5:
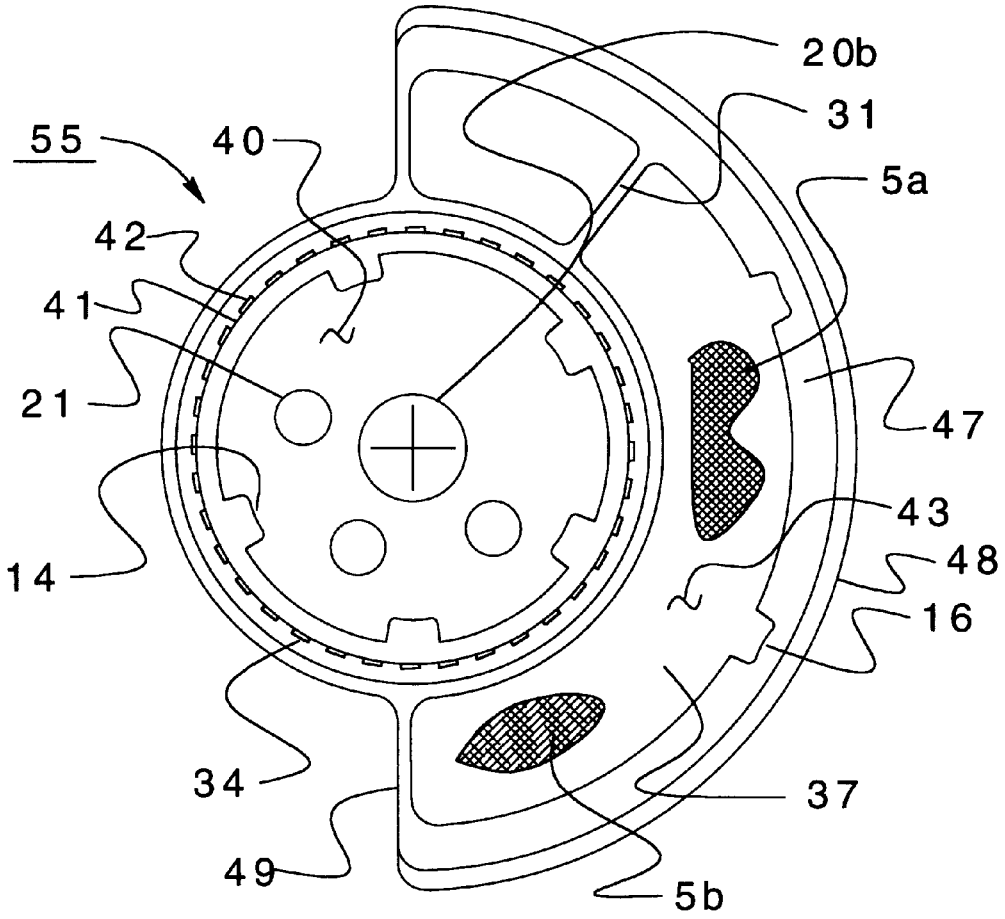
FIG. 5 is an overhead view showing a modification of the embodiment shown in FIGS. 1 and 2.
Figure 6:
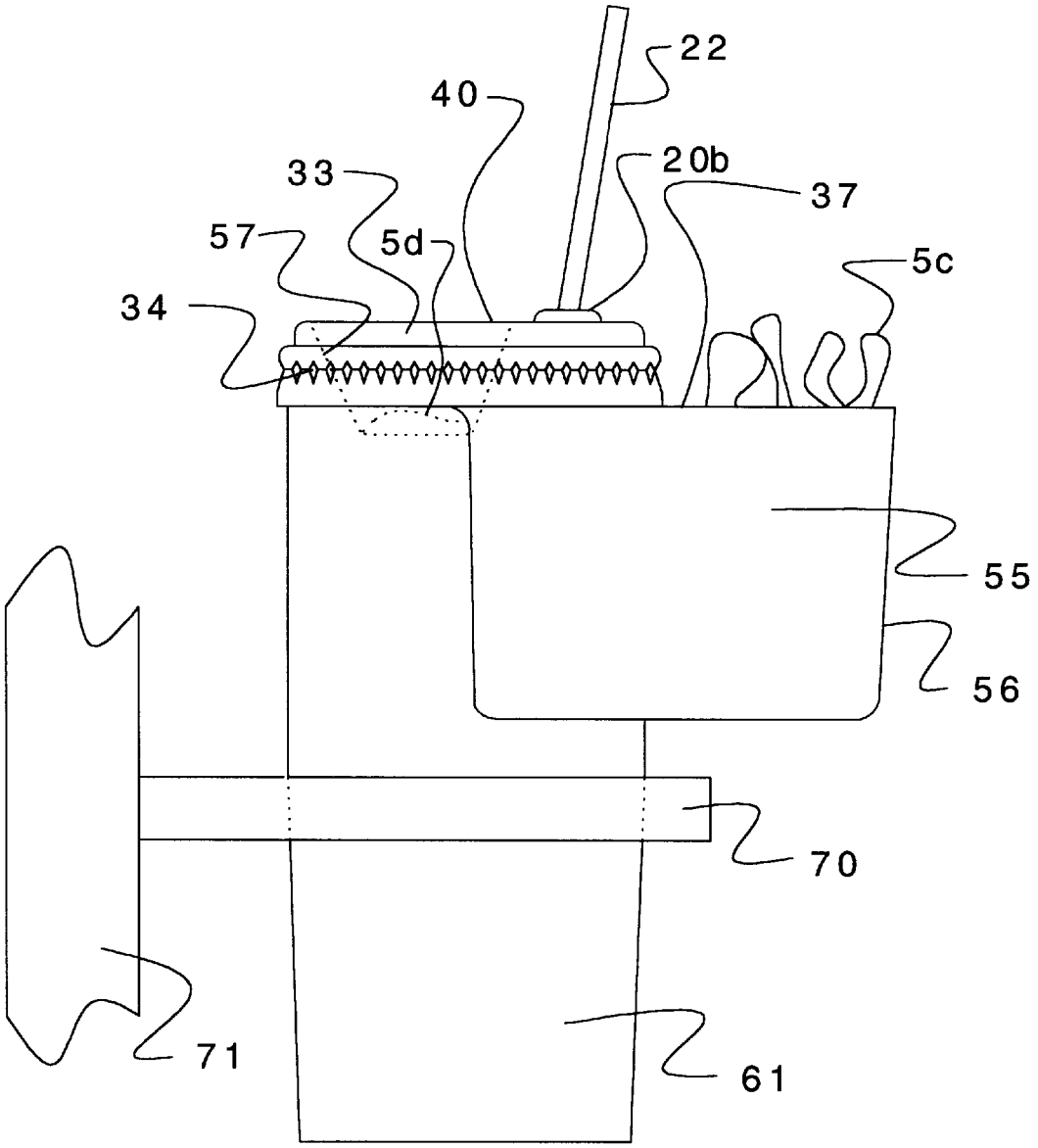
FIG. 6 is a side view showing a modification of the embodiment of FIG. 5 attached to a beverage container.

FIGS. 5 and 6 show a disposable plastic thin walled plate-lid, which is designed for a single time use and could be used in fast food establishments, sporting events, entertainment functions and the like where it would be advantageous to combine both plate or tray with a beverage container in a configuration in which the outer well or channel can not be circumferenctial with respect to the inner beaded rim due to positioning the plate-lid beverage container assembly within the environment.

Referring to FIG. 5, the inner region 40 is defined within beaded rim 34 containing an elevated straw knockout 20*b* and beverage type indicator dots 21. The beaded rim 34 is differentiated by flutes 42 interspaced by lands 41 around the inner circumferential skirt to engage the rim of a beverage container as previously described. The inner region has lugs 14 spaced and the outer region 43 has gaps 16 within the outer flange 47 spaced at predetermined angles and circumferential lengths as previously described for stacking. Outer region 43 has wells or channels 37 separated by partitions 31 for containing food stuffs 5*a* and 5*b*. The outer flange 47 has a non-circumferential profile 49 which terminates at outer ridge 48.

FIG. 6 illustrates plate-lid 55 on beverage container 61 as positioned within cup holder 70 protruding from plane 71 as typically found in an automobile. Plate-lid 55 illustrates outer well or channel 37 at depth 56 predetermined for locating food stuffs 5*c* within well or channel 37. Straw 22 is protruding through straw knockout location 20*b*. Inner region 40 illustrates inner well or channel 33 at a depth 57 predetermined for locating condiment 5*d* within. Beaded rim 34 is engaged or sealed against the rim of beverage container 61.

With respect to the above description then, it is to be realized that the optimum dimensional relationships for the parts of the invention, to include variations in size materials, shape, form, function and the manner of operation, and use, are deemed readily apparent and obvious to one skilled in the art, and all equivalent relationships to those illustrated in the drawings and described in the specifications are intended to be encompassed by the present invention. The method of manufacturing the plate-lid invention varies considerably based upon the materials and requirements of the specific manufacturing process. Injection molding, thermoforming and the like may be considered appropriate for manufacturing the invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modification and equivalents may be resorted to, falling within the scope of the invention.

What is claimed is:

1. A plate-lid having a generally circular inner region surrounded by a beaded inner rim wherein the plate-lid can be stacked with other plate-lids having aligned central axes and wherein said plate-lid comprises:

a.) an intermediate skirt depending from said inner rim for engaging the beaded rim of a beverage container; and b.) a food holding section contained as an integral part of the plate;

c.) said beaded skirt being defined by a series of circumferentially spaced lands interspersed by flutes engagable with the rim of the beverage container.

2. A disposable plastic plate-lid having a generally circular inner region surrounded by a beaded inner rim wherein the plate-lid can be stacked with other plate-lids having aligned central axes and wherein said plate-lid comprises:

a.) an intermediate skirt depending from said inner rim for engaging the beaded rim of a beverage container;

b.) a food holding section contained as an integral part of the plate-lid; and c.) stabilizing means for counteracting both lateral and axial loads during stacking to maintain stack integrity while preventing jamming of adjacent plate-lids, said stabilizing means including:

1.) anti-jamming means for preventing sticking of adjacent plate-lids during stacking including a plurality of lug or gap members extending downwardly from said inner region for a sufficient distance to engage the inner region of a lower plate-lid ; and 2.) anti-shifting means for preventing relative lateral movement of adjacent plate-lids during stacking, said anti-shifting means including the portion of said inner region which lies above the inner region of an upper adjacent plate-lid.

3. A plate-lid as defined in claim 2, wherein said lug or gap members have a predetermined circumferential extent and have a midpoint which is circumferentially spaced a predetermined distance from the diametrical axis.

4. A plate-lid as defined in claim 3 wherein said anti-jamming and anti-shifting means further includes a plurality of circumferentially spaced flutes provided about said skirt and a plurality of lands provided between each of said flutes with said flutes varying in their circumferential length to thereby vary the spacing between said lands, with said lands of plate-lid forming an inner waist which rests on said rim portion of the lower adjacent plate-lid.

5. A disposable plastic plate-lid as defined in claim 2 wherein said lugs are positioned around the inner region by varying circumferential distances so that adjacent lugs are out of phase with each other.

6. A plate-lid as defined in claim 1 where in the food holding section comprises a well or channel region outside the circumferential skirt depending from the rim portion for engaging the beaded rim of the beverage container.

7. A plate-lid as defined in claim 6 where the food holding section comprises a complete circumferential outer rim around the circumferential skirt depending from the rim portion for engaging the beaded rim of the beverage container.

8. The plate-lid as defined in claim 7 where the well or channel region has a specified depth based upon a selected food stuffs portion used within the region.

9. A plate-lid as defined in claim 6 wherein the food holding section comprises an outer well or channel depending about a portion of the circumferential skirt depending from the rim portion for engaging the beaded rim of the beverage container.

10. The plate-lid as defined in claim 1 wherein the food holding section comprises a well or channel portion positioned within the skirt depending from the rim portion for engaging the beaded rim of the beverage container.

11. The plate-lid as defined in claim 10 wherein the food holding section comprises a well or channel portion outside the skirt depending from the rim portion for engaging the beaded rim of the beverage container.

12. An elongated container disposed to hold a selected beverage and a plate-lid for said container having a generally circular inner region surrounded by a beaded inner rim to mate with said container wherein the plate-lid can be stacked with other plate-lids having aligned central axes and wherein said plate-lid comprises:

a.) an intermediate skirt depending from said inner rim for engaging the beaded rim of a beverage container; and b.) a food holding section contained as an integral part of the plate-lid;

c.) said beaded skirt being defined by a series of circumferentially spaced lands interspersed by flutes engagable with the rim of the beverage container.

13. Serving arrangement comprising an elongated container disposed to hold a selected beverage and a plate-lid for said container having a generally circular inner region surrounded by a beaded inner rim to mate with said container wherein the plate-lid can be stacked with other plate-lids having aligned central axes and wherein said plate-lid comprises:

a.) an intermediate skirt depending from said inner rim for engaging the beaded rim of said beverage container;

b.) a food holding section contained as an integral part of the plate-lid; and c.) stabilizing means for counteracting both lateral and axial loads during stacking to maintain stack integrity while preventing jamming of adjacent plate-lids, said stabilizing means including:

1.) anti-jamming means for preventing sticking of adjacent plate-lids during stacking including a plurality of lug or gap members extending downwardly from said inner region for a sufficient distance to engage the inner region of a lower adjacent plate-lid; and 2.) anti-shifting means for preventing relative lateral movement of adjacent plate-lids during stacking, said anti-shifting means including the portion of said inner region which lies above the inner region of an upper adjacent plate-lid.

14. Serving arrangement as defined in claim 13, wherein said lug or gap members have a predetermined circumferential extent and have a midpoint which is circumferentially spaced a predetermined distance from the diametrical axis.

15. Serving arrangement as defined in claim 14 wherein said anti-jamming and anti-shifting means further includes a plurality of circumferentially spaced flutes provided about said skirt and a plurality of lands provided between each of said flutes with said flutes varying in their circumferential length to thereby vary the spacing between said lands, with said lands of plate-lid forming an inner waist which rests on said rim portion of the lower adjacent plate-lid.

16. A serving arrangement as defined in claim 13 wherein said lugs are located around the inner region by varying arcuate distances so that adjacent lugs are out of phase with each other.

17. Serving arrangement as defined in claim 12 where in the food holding section comprises a well or channel region outside the circumferential skirt depending from the rim portion for engaging the beaded rim of the beverage container.

18. Serving arrangement as defined in claim 17 where the food holding section comprises a complete circumferential outer rim around the circumferential skirt depending from the rim portion for engaging the beaded rim of the beverage container.

19. Serving arrangement as defined in claim 18 where the well or channel region has a specified depth based upon a selected food stuffs portion used within the region.

20. Serving arrangement as defined in claim 17 wherein the food holding section comprises an outer well or channel depending about a portion of the circumferential skirt depending from the rim portion for engaging the beaded rim of the beverage container.

21. Serving arrangement as defined in claim 12 wherein the food holding section comprises a well or channel portion positioned within the skirt depending from the rim portion for engaging the beaded rim of the beverage container.

22. Serving arrangement as defined in claim 21 wherein the food holding section comprises a well or channel portion outside the skirt depending from the rim portion for engaging the beaded rim of the beverage container.

* * * * *